United States Patent [19]

Chiaves

[11] Patent Number: 4,693,634

[45] Date of Patent: Sep. 15, 1987

[54] PREFABRICATED SUPPORT AND COVERING STRUCTURE, PARTICULARLY FOR CONSTRUCTING TUNNELS, BRIDGES AND THE LIKE

[75] Inventor: Carlo Chiaves, Turin, Italy

[73] Assignee: Tensiter S.p.A., Turin, Italy

[21] Appl. No.: 834,277

[22] PCT Filed: May 31, 1985

[86] PCT No.: PCT/EP85/00259

§ 371 Date: Feb. 5, 1986

§ 102(e) Date: Feb. 5, 1986

[87] PCT Pub. No.: WO85/05653

PCT Pub. Date: Dec. 19, 1985

[30] Foreign Application Priority Data

Jun. 5, 1984 [IT] Italy ..... 67581 A/84

[51] Int. Cl.[4] ..... E21D 5/00

[52] U.S. Cl. ..... 405/126; 52/86; 405/124; 405/151

[58] Field of Search ..... 405/124, 125, 126, 150–153, 405/146; 52/88, 89, 745, 86

[56] References Cited

U.S. PATENT DOCUMENTS

| | | | |
|---|---|---|---|
| 587,392 | 8/1897 | Gray | 405/126 |
| 678,605 | 7/1901 | Wolcott | 405/124 |
| 701,034 | 5/1902 | Gray | 405/124 |
| 1,784,271 | 12/1930 | Collins | 405/124 |
| 3,535,883 | 12/1950 | Williamson | 405/124 |
| 3,593,482 | 7/1971 | Johnson | 52/745 |
| 3,808,754 | 5/1974 | Bottjer et al. | 52/745 X |
| 3,834,005 | 9/1974 | Johnson | 52/758 H X |
| 3,854,266 | 12/1974 | Salas | 52/742 |
| 4,124,985 | 11/1978 | Maimets | 405/150 |

FOREIGN PATENT DOCUMENTS 1534627 6/1969 Fed. Rep. of Germany .

*Primary Examiner*—Dennis L. Taylor

*Attorney, Agent, or Firm*—Sughrue, Mion, Zinn, Macpeak, and Seas

[57] ABSTRACT

A prefabricated support and covering structure for making artificial tunnels, small bridges, and the like, is comprised of a plurality of modular bodies each of which consists of a plurality of prefabricated reinforced concrete panels interconnected by reinforcing rods so that upon lifting of the center portion of each modular body the prefabricated panels will fold about hinges defined by the reinforcing rods. The reinforcing rods are disposed at angles relative to each other and intersect along a line parallel to the axis of the structure, which line defines the hinge axis. Each prefabricated panel of reinforced concrete has abutting edges and the gap between the confronting faces of the panels is filled with binding material. The modular bodies are each provided with lateral flanges to define a space between the lateral spaces of adjacent bodies which is also filled with a binding material to unite the modular bodies to each other.

4 Claims, 14 Drawing Figures

PREFABRICATED SUPPORT AND COVERING STRUCTURE, PARTICULARLY FOR CONSTRUCTING TUNNELS, BRIDGES AND THE LIKE

The invention relates to prefabricated support and cover structures, particularly for making tunnels, bridges and the like. More precisely the invention relates to prefabricated structures including a number of modular bodies of polygonal sector shape disposed side-by-side in succession along the longitudinal axis of the structure.

The problem which arises in structures of the aforesaid kind is that of making modular bodies, at least partly prefabricated, which can be handled, which are easy to install on site and which are predisposed so as to form, when assembled, a solid and monolithic structure.

Some structures used in the field of construction of artificial tunnels, small bridges and the like envisage the prefabrication of only the roof panels, with the disadvantage of having to cast on site the piers, that is, the pillars and/or lateral support walls. Other structures envisage separate prefabrication of the roofs and piers; in this case it proves particularly difficult to achieve satisfactorily and economically a rigid connection between the roof and piers; more commonly, in fact, use is made of covers which simply rest on the piers, even though much greater thicknesses and reinforcements are needed. Apart from the above, other structures are also available in which the modular bodies are prefabricated in a single monolithic element and thus have smaller thicknesses; such modular bodies are, however, difficult to transport, so that it is practically impossible to use them to build structures of relatively large dimensions.

The object of the present invention is to provide a prefabricated support and covering structure, particularly for constructing artificial tunnels, small bridges and the like, which does not have substantially the disadvantages previously mentioned and allows the construction of very solid structures, of relatively large dimensions, using modular bodies which are almost completely prefabricated and at the same time easily transportable.

With a view to achieving this object the invention provides a prefabricated support and covering structure particularly for building artificial tunnels, small bridges and the like, comprising a plurality of modular bodies in the shape of polygonal sectors, arranged side-by-side in succession along the longitudinal axis of the structure, characterised in that each modular body is constituted by at least one prefabricated element comprising two or more panels of reinforced concrete disposed in succession along the polygonal line which defines the cross-section of the prefabricated structure, each panel being connected to the adjacent panel by articulation means and means for reciprocal positioning, the articulation means consisting of a plurality of connecting reinforcement rods extending from each panel to the adjacent panel.

The invention will now be described with reference to a preferred practical embodiment illustrated in the appended drawings, supplied purely by way of non-limiting example, in which.

Figure 1:
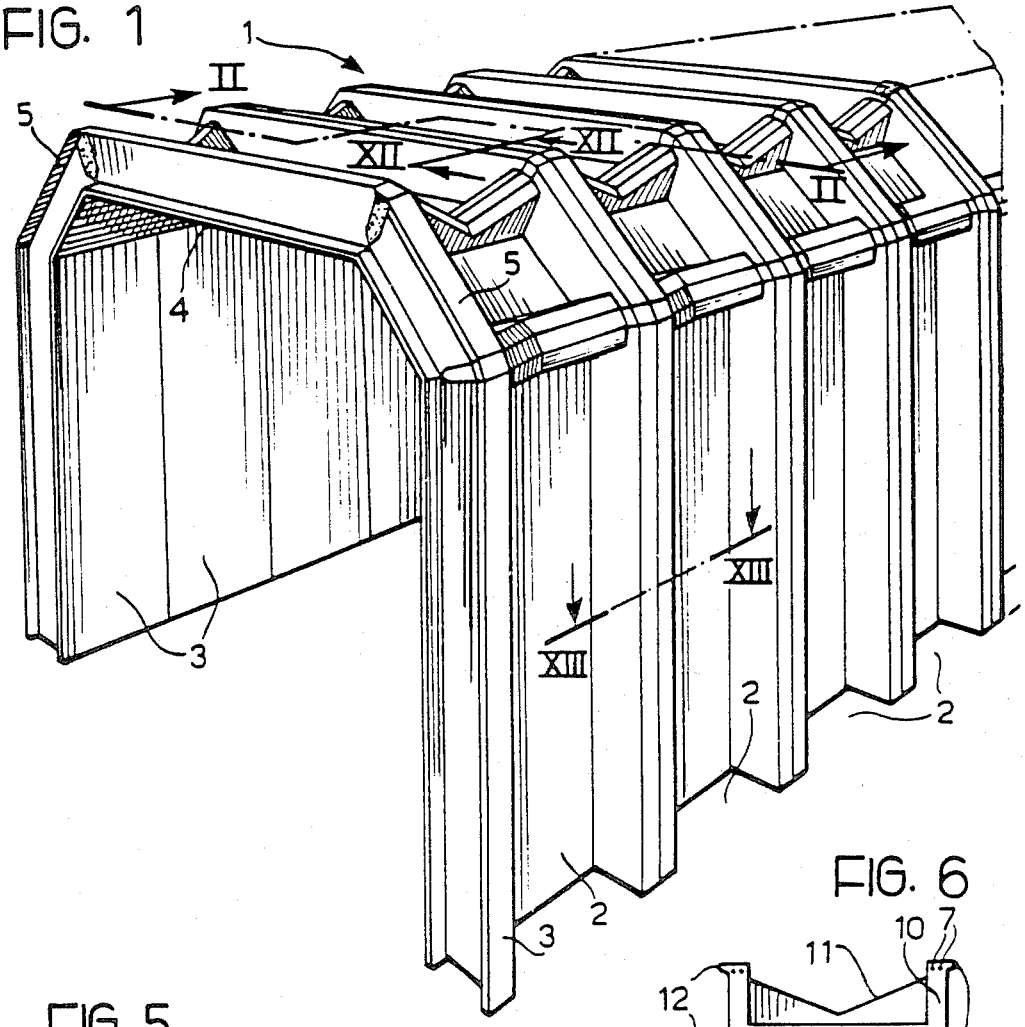
FIG. 1 is a perspective view of a prefabricated support and covering structure according to the invention.
Figure 6:
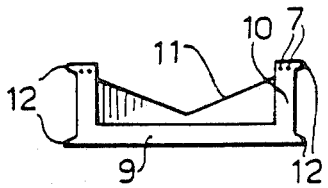
FIG. 6 and FIG. 7 are sections taken along the lines VI—VI and VII—VII respectively in FIG. 4.
Figure 5:
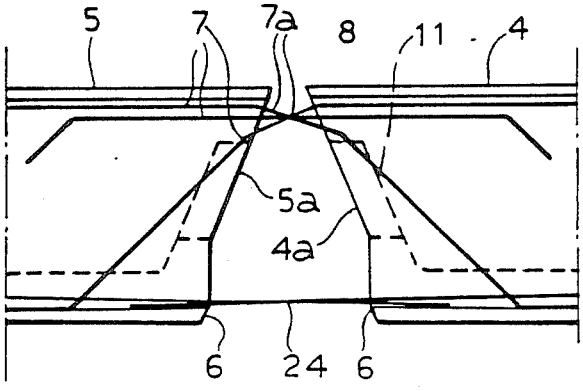
FIG. 5 is a view on an enlarged scale of a detail of FIG. 4.
Figure 7:
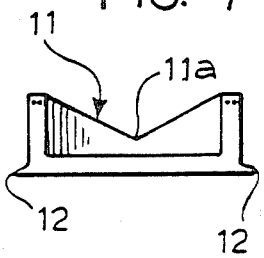
Figure 2:
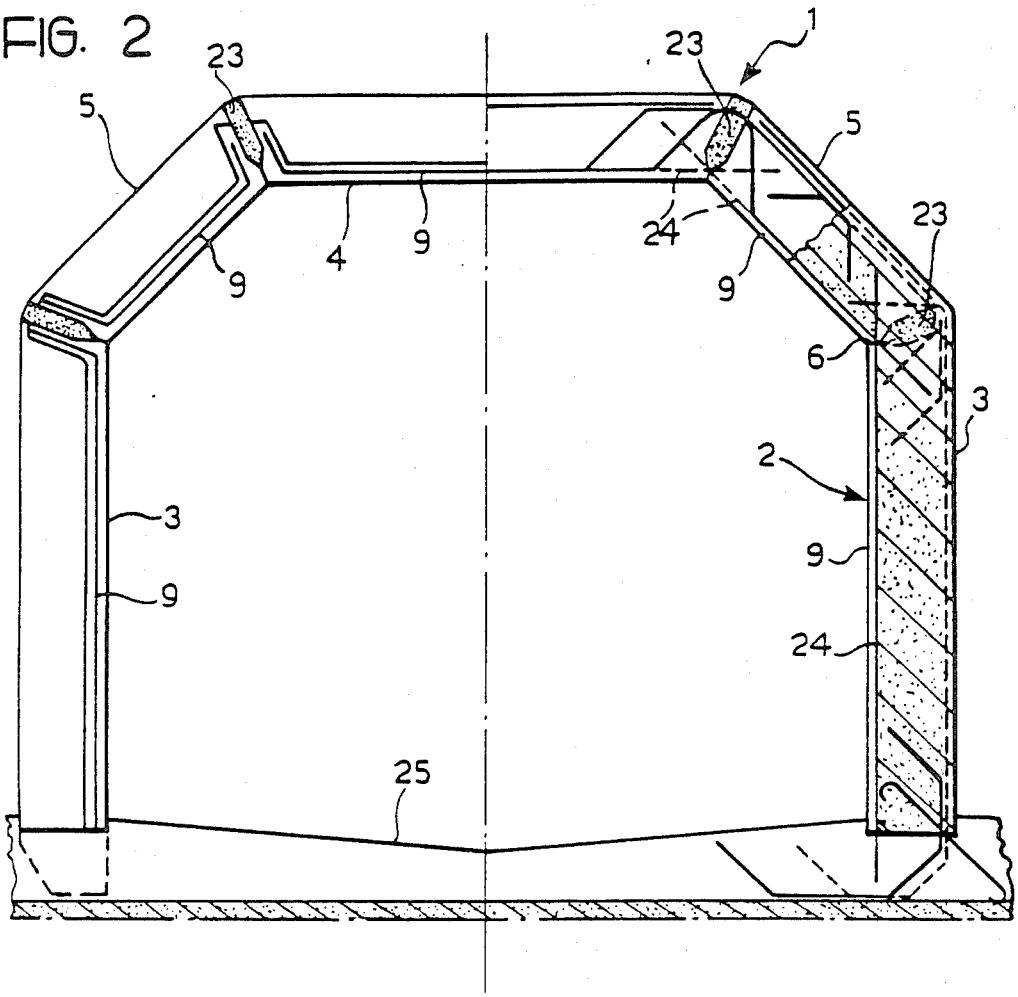
FIG. 2 is a front view, partially in section, taken along the line II—II of the structure of FIG. 1.
Figure 12:
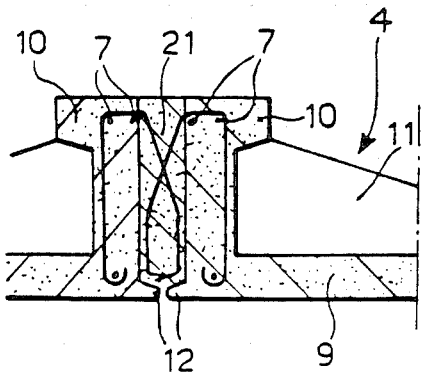
FIGS. 12 and 13 are sectional views taken along the lines XII—XII and XIII—XIII in FIG. 1.
Figure 13:
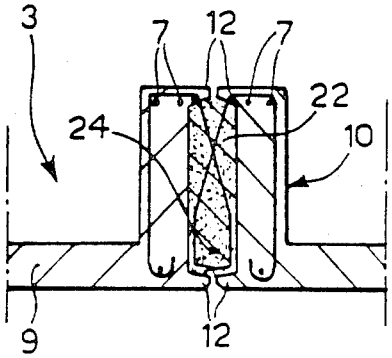

Indicated as 1 in its entirety is a prefabricated support and covering structure, particularly suitable for building artificial tunnels, small bridges and the like, such as, for example, underground passages, covered ducts, box structures etc. The structure 1 consists of a plurality of modular bodies 2 disposed in succession, each in the form of a half-ring consisting of a polygon with five sides. The structure 1 has, consequently, a polygonal cross section corresponding to that of the adjacent modular bodies 2.

Each modular body 2 is formed by a prefabricated element comprising five prefabricated panels forming the five sides of the aforesaid polygon. The outermost panels indicated at 3 constitute on site the side walls of the prefabricated structure. The centre panel 4 and the intermediate panels 5 constitute the roof on site. Each modular body 2 is prefabricated under such conditions that the five panels indicated as 3, 4 and 5 are arranged in substantial alignment along a straight line as indicated in FIGS. 3 and 4.

In this way the modular body 2 is more easily made and is very easily transportable.

Each panel includes a base wall 9, which on site constitutes the inner concave surface of the prefabricated structure, and two transverse ribs 10 disposed adjacent the lateral edges of the panel. Within the aforesaid ribs, in proximity to the edge opposite the wall 9, there are disposed reinforcing rods indicated at 7 which extend from one panel to the adjacent panel, constituting the sole connection between them. The portions 7*a* of the rods 7 which are interposed between two adjacent panels are inclined to each other and so disposed as to intersect on a common straight line, indicated 8, substantially parallel to the longitudinal axis of the structure 1. The adjacent end faces 3*a*, 4*a* and 5*a* of the panels 3, 4, 5 respectively, which constitute the modular body 2, have, in a position adjacent the wall 9, a longitudinal bevel edge 6 which extends over the whole longitudinal depth of the modular body 2. The longitudinal bevel edges 6 come into contact with each other when the modular body 2 is erected on site. Each panel which constitutes the modular body 2 is formed with a longitudinal rib 11 along each edge face turned towards the adjacent panels. Each longitudinal rib 11 has, in its central region, a recess 11*a* relative to the transverse ribs 10 so as to facilitate, in the erected structure, the passage of cables or ducts. The transverse ribs 10 of the panels 3 and 5 are provided with a pair of spaced apart edge flanges 12 extending over the entire length of the edge of the corresponding panel. The transverse ribs 10 of the central panel 4 are provided with a single edge flange 12 adjacent the wall 9 of the said panel.

Figure 3:
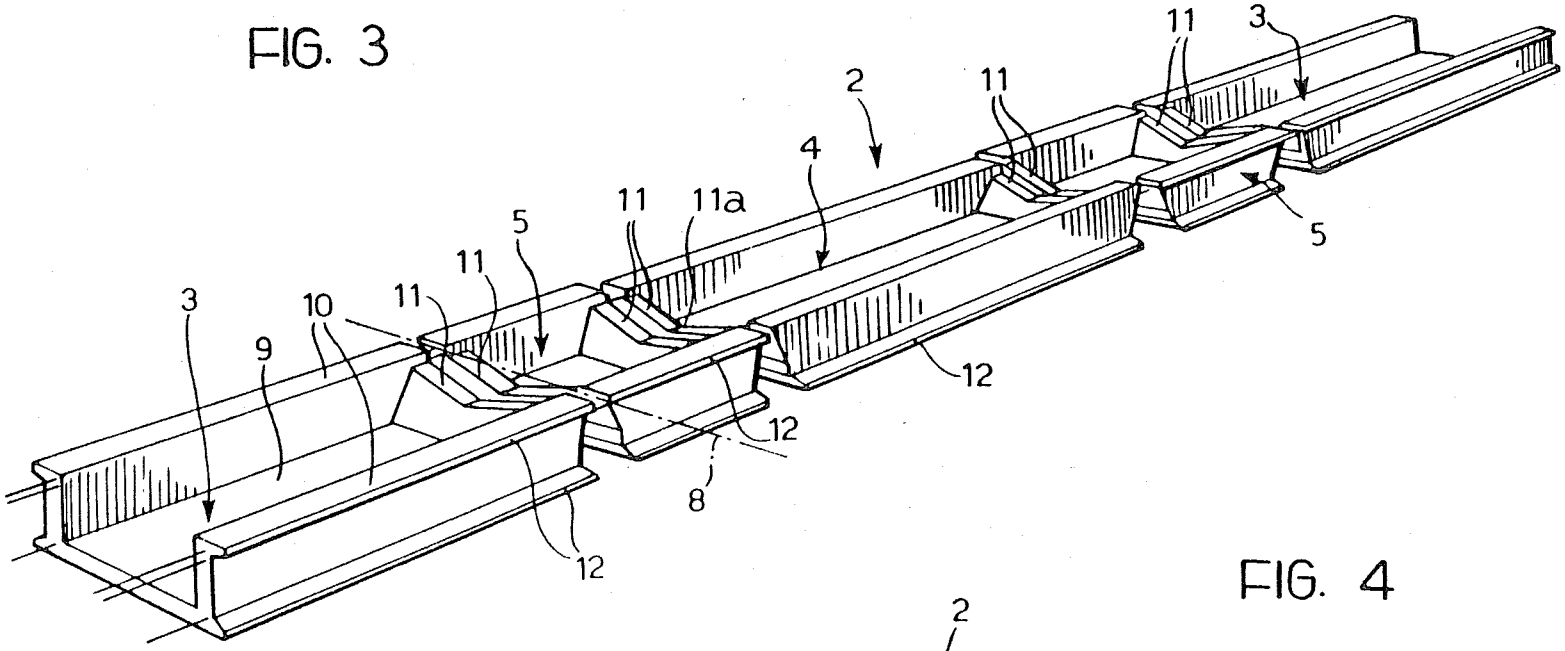
FIG. 3 is a perspective view of a component of FIG. 1 illustrated on site, before erection.
Figure 4:
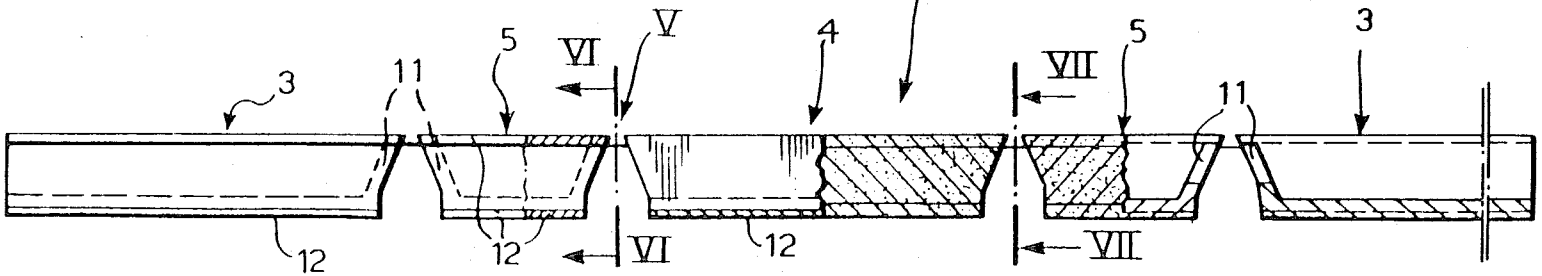
FIG. 4 is a lateral view in the direction of the arrow IV in FIG. 3.
Figure 8:
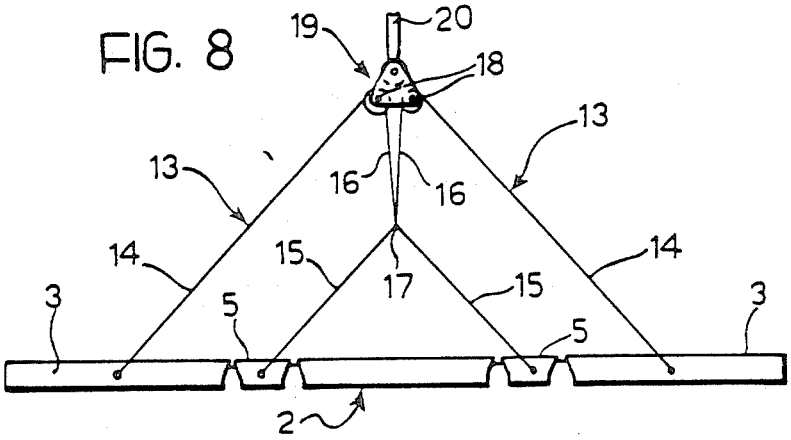
FIGS. 8, 9, 10, 11 are diagrammatic views of a device for lifting the component in FIG. 3, arranging it in its final assembly form and installing it on site, illustrated in various successive operational stages.
Figure 9:
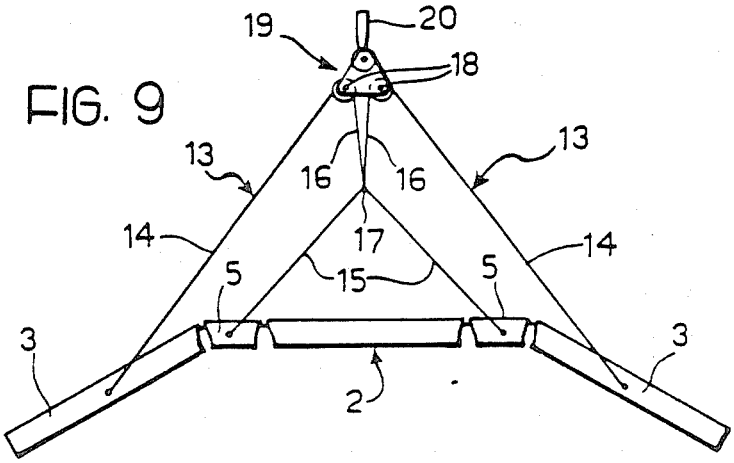
Figure 10:
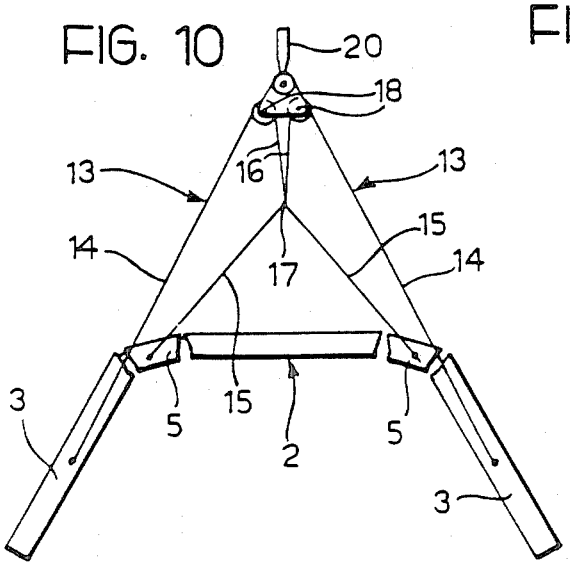

FIGS. 8, 9, 10 and 11 illustrate a device designed to lift the modular body 2 in its pre-erection state shown in FIG. 3, in order to raise it and deform it until it is made to assume the final conformation corresponding to that of its erection on site. The aforesaid device consists of two side-by-side cables 13, each of which has two straight end portions, a longer one 14 and a shorter one 15, and an intermediate portion connecting the two, indicated at 16. The two cables 13 are connected together by a connecting ring 17 interposed between the portions 15 and 16, and by two pulleys 18 interposed between the portions 16 and 14. The pulleys 18, possibly fitted with brakes, form part of a mechanism 19 designed to be grappled by a hook 20 and lifted by the latter. The longer straight end portions 14 of the cables 13 are connected at their free ends to the lateral panels 3 of the modular body 2. The shorter straight end portions 15 are on the other hand connected to the intermediate panels 5 of the said modular body 2. In this manner, elevation of the mechanism 19 causes a raising of the said panels and finally of the entire modular body 2. The length and arrangement of the cables 16 are such that the action of the latter upon the body 2, combined with the force of gravity acting upon the various panels 3, 4, 5 which constitute the latter, is such as to cause relative rotation between the panels, bending the portions *7a* of the connecting rods. This rotation, which occurs progressively as illustrated in the sequence of FIGS. 8, 9, 10 and 11, takes place around the straight line 8 which therefore constitutes an axis of articulation between the adjacent panels. In the final stage of this operation, the outer straight end portions 14 of the cables 13 rest upon a suitably pre-positioned reaction point 14*a*.

Figure 11:
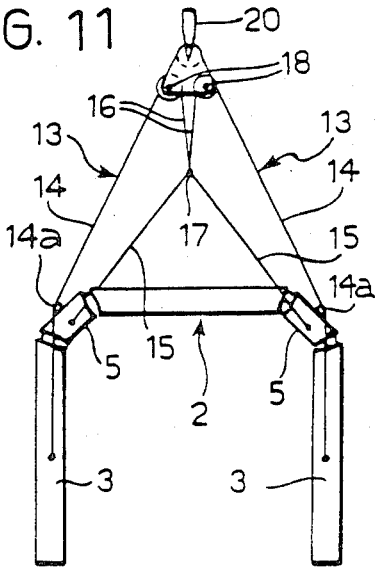

The contiguous panels rotate progressively until their facing longitudinal edges 6 come into contact with each other, as shown in FIG. 11. The modular body 2 has then reached its final conformation and can therefore be installed alongside the other previously positioned modular bodies 2. Between the edges of the upper central panels 4 of the side-by-side modular bodies 2 a space 21 is formed which is open at the top and delimited below by the corresponding edge flanges 12. Between the facing edges of the adjacent panels 3 and 5 spaces 22 are formed which are closed and delimited by the corresponding edge flanges 12. Between the contiguous faces of the adjacent panels 3, 4 and 5 of each modular body 2 spaces 23 are formed which are open towards the outside and which are closed and delimited on the inside by the corresponding longitudinal bevels 6. Reinforcing rods indicated 24 are located on site in the said spaces 21, 22 and 23, and liquid concrete is then poured into the spaces 21 and 23, spreading within the said spaces and into the spaces 22, and thereby achieving the monolithicity of the various modular bodies 2 to form a single structure 1. A concrete foundation 25 is also cast on site, by known methods.

Figure 14:
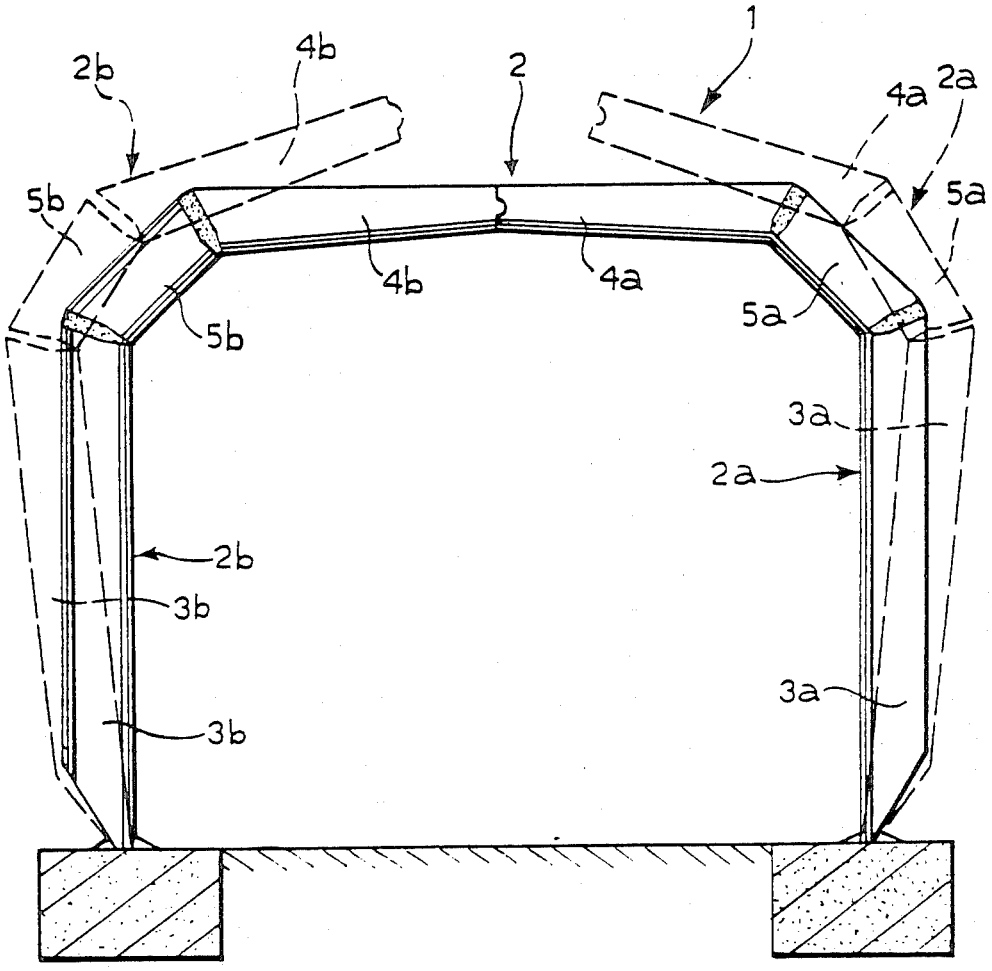
FIG. 14 is a variant of FIG. 2.

The structure 1 thus produced consists of modular bodies 2 each formed from a single prefabricated element. In FIG. 14, on the other hand, there is shown a structure 1, the modular bodies 2 of which consist of two contraposed prefabricated elements 2*a*, 2*b* connected together overhead at the centre of the modular body 2 (the elements 2*a* and 2*b* during erection and before interconnection are indicated by broken lines). Each prefabricated element 2*a*, 2*b* consists of three panels 3*a*, 4*a*, 5*a* and 3*b*, 4*b*, 5*b* respectively: the panels 3*a* and 3*b* form on site the lateral walls of the modular body 2; the panels 5*a* and 5*b* form the inclined sides and the panels 4*a* and 4*b* the upper sides of the covering wall of the modular body 2.

Naturally, while the principle of the invention remains the same, the forms of construction and operation may be widely varied relative to what has been described and illustrated, without nevertheless going beyond the scope of this invention.

For example, the portions *7a* of the rods 7, instead of intersecting on the straight line 8, can be disposed so as to lie in a single plane parallel to the longitudinal axis of the structure 1 thus allowing, in this case also, the relative rotation of the panels upon erection.

Moreover, the panels, instead of being flat, may also be provided with a curvature designed to form structures which have, at least partly, a curved shape.

Finally, the portions *7a* of the reinforcing rods 7 may also be placed in proximity to the base walls 9 of the panels so as to form the articulation hinge between the contiguous panels in positions adjacent the inner concave surface of the structure 1. In this case the reciprocal positioning of the panels may be achieved by arranging, for example curved connecting rods and flexible elements which extend from one panel to the adjacent one in proximity to the free edges of the ribs 10: during erection the adjacent panels rotate relative to each other, causing progressive extension of the curved rods or of the flexible elements the length of which defines the final reciprocal position of the panels.

What is claimed is:

1. A prefabricated support and covering structure particularly for making artificial tunnels, small bridges and the like, comprising a plurality of modular bodies, in the form of a polygonal section having an outer convex surface and an inner concave surface when disposed side-by-side in succession along the longitudinal axis of the structure, each modular body including a plurality of prefabricated panels of reinforced concrete having adjacent end faces, each panel being connected to the adjacent panel by articulation means comprised of a plurality of connecting reinforcement rods extending without interruption from each panel to the adjacent panel to allow relative rotation between adjacent panels from a coplanar disposition to an erect, folded postion in which portions of the end faces of adjacent panels are brought into mutual contact, the improvement comprising:

said connecting reinforcement rods having portions between each pair of adjacent panels which are inclined to each other and intersect on a common straight line substantially parallel to the longitudinal axis of the structure, the said straight line forming an articulation hinge axis, said connecting reinforcement rods extending from each panel to the adjacent panel being disposed in proximity to the outer convex surface of the prefabricated structure, each of said end faces of the adjacent panels being inwardly inclined and being provided, in proximity to the concave inner surface of the prefabricated structure, with a front edge which is substantially parallel to the longitudinal axis of the prefabricated structure; the two front edges of each pair of adjacent panels being substantially in longitudinal contact with each other so as to constitute a reciprocal abutment and to define, with the respective adjacent surfaces of the said end faces, a longitudinal space filled with a binding material cast on site, and wherein said panels of each modular body have lateral faces spaced from the lateral faces adjacent modular bodies and have lateral flanges spaced apart and disposed substantially parallel to a polygonal line which defines the cross section of the prefabricated structure, said lateral flanges of one modular body being substantially in contact upon erection with the corresponding lateral flanges of the adjacent modular body so as to form a space between said lateral faces and lateral flanges extending parallel to the said polygonal line and interposed between the two adjacent modular bodies, the said space being filled with binding material cast on site.

2. Structure according to claim 1 characterised in that the connecting rods extending between adjacent panels also extend within the latter, constituting reinforcing elements of the said reinforced concrete panels.

3. Structure according to claim 1 characterised in that each panel of each modular body includes a base wall which upon erection forms part of the inner concave wall of the prefabricated structure and at least two transverse ribs disposed in correspondence with and parallel to the two lateral edges of the panel, the said transverse ribs having upon their external lateral faces the lateral flanges and upon their end faces the front edge and the connecting rods extending between adjacent panels.

4. Structure according to claim 1 characterised in that each panel has, in correspondence with each of its front end surfaces which upon erection face an adjacent panel, a longitudinal rib parallel to the axis of the prefabricated structure and extending from one transverse rib to the other, each end face of the panel having the connecting rods extending between the corresponding transverse side of the adjacent panels, and the front edge extending along the longitudinal rib between one transverse rib and the next of said panel.

* * * * *